United States Patent [19]

Melin et al.

[11] Patent Number: 4,743,360

[45] Date of Patent: May 10, 1988

[54] PROCESS FOR REMOVING BASIC NITROGEN COMPOUNDS FROM GAS OILS

[75] Inventors: Michel Melin, Seneffe; Jacques F. Grootjans, Leefdaal; Andre Vanderlinden, Brussels, all of Belgium

[73] Assignee: Labofina, S.A., Brussels, Belgium

[21] Appl. No.: 922,470

[22] Filed: Oct. 23, 1986

[30] Foreign Application Priority Data

Oct. 24, 1985 [LU] Luxembourg ..... 86141

[51] Int. Cl.[4] ..... C10G 21/00

[52] U.S. Cl. ..... 208/254 R; 208/265; 208/282

[58] Field of Search ..... 208/254 R

[56] References Cited

U.S. PATENT DOCUMENTS

| | | | |
|---|---|---|---|
| 2,541,458 | 2/1951 | Berg | 208/254 R |
| 2,729,595 | 1/1956 | Denlon et al. | 208/254 R |
| 2,847,362 | 8/1958 | Kemp | 208/254 R |
| 2,902,428 | 9/1959 | Kimberlin, Jr. et al. | 208/254 R |
| 2,944,063 | 7/1960 | Paulsen | 208/254 R |
| 2,971,906 | 2/1961 | Webster | 208/254 R |
| 3,719,587 | 3/1973 | Karchmer et al. | 208/254 R |
| 3,847,800 | 11/1974 | Guth | 208/254 R |
| 4,159,940 | 7/1979 | Smith | 208/254 R |
| 4,209,385 | 8/1983 | Stover | 208/254 R |
| 4,392,948 | 7/1983 | Debande | 208/254 R |

*Primary Examiner*—Helen M. S. Sneed
*Assistant Examiner*—Helane Myers
*Attorney, Agent, or Firm*—Roger W. Parkhurst; John K. Abokhair; M. Norwood Cheairs

[57] ABSTRACT

A process for removing the basic nitrogen compounds from gas oils comprises treating the gas oils with a homogeneous solvent mixture comprising a diluted aqueous acid solution and an alcohol having from 1 to 6 carbon atoms, the volume ratio of alcohol to diluted aqueous acid solution being between 90/10 and 10/90, the volume ratio of solvent mixture to gas oils being between 0.5 and 5.

9 Claims, 1 Drawing Sheet

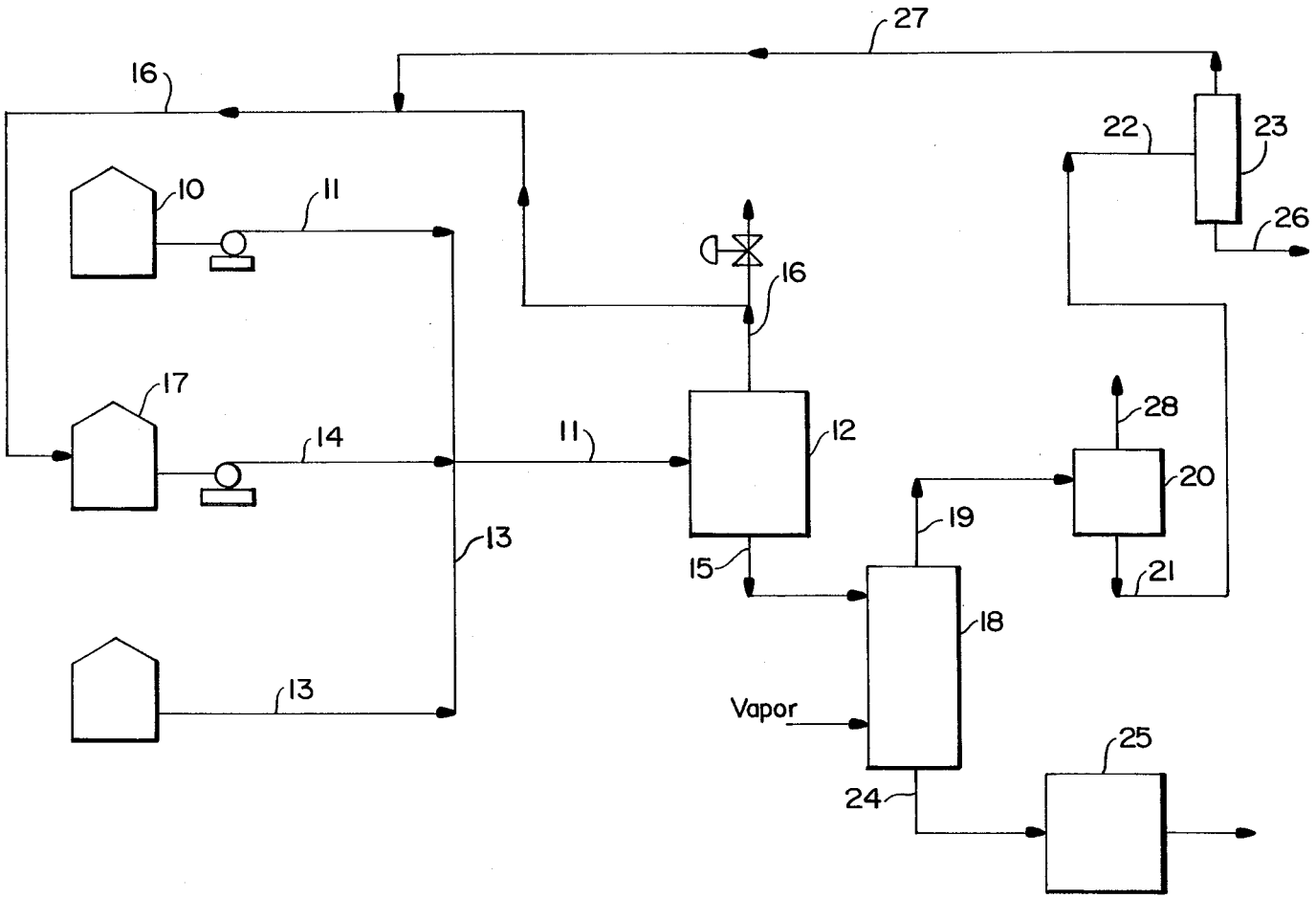
23
26
22
27
28
20
21
25
18
19
24
Vapor
12
16
15
11
13
11
14
13
10
17
16

PROCESS FOR REMOVING BASIC NITROGEN COMPOUNDS FROM GAS OILS

FIELD OF THE INVENTION

The present invention relates to an improved process for removing basic nitrogen compounds from gas oils, particularly from vacuum gas oils which are to be submitted to catalytic cracking. More particularly, the present invention relates to an improved process for removing from gas oils some compounds having a basic nitrogen function, while avoiding the formation of undesirable compounds which significantly reduce the amount of available gas oils.

BACKGROUND OF THE INVENTION

It is well known that vacuum gas oils resulting from thermal conversion processes, such as visbreaking and coking, are particularly rich in basic nitrogen compounds. These vacuum gas oils, particularly waxy hydrocarbons, are submitted to catalytic cracking in order to form lighter hydrocarbons. Moreover, it is well known that the catalysts used in catalytic cracking, particularly zeolites, are poisoned by basic nitrogen compounds which are contained in gas oils. The poisoning of the acid sites of the catalysts leads to a reduction of the conversion rate of as much as 10 to 20%.

The nitrogen compounds which are contained in hydrocarbon feedstocks, typically the vacuum gas oils, are present for a major part in the form of basic compounds. In order to render the gas oils suitable for further treatment, it is necessary to reduce considerably the amount of the basic nitrogen compounds.

It has already been proposed to treat hydrocarbon feedstocks having a boiling point between 200° and 650° C., which have to be further submitted to thermal or catalytic cracking to form gasolines, with an organic or inorganic acid, but this treatment only partially eliminates the nitrogen compounds. Moreover, when a treatment with concentrated sulphuric acid is used, part of the compounds of the feedstocks is transformed by sulfonation, causing significant loss.

The present assignee's Belgian Pat. No. 884149 discloses treating liquid hydrocarbon mixtures with very dilute aqueous acid solutions. This technique may be applied to the gas oils, but with difficulties due to their high content in basic nitrogen compounds and due to the low efficiency of the diluted solutions on the vacuum gas oil feed.

There exist still other processes which use a packed column and medium concentrated acid solutions in the order of 65%. These processes concern particularly liquid hydrocarbons and therefore could not be easily adapted to vacuum gas oils, which are present in the form of a relatively viscous wax.

Therefore there is a need for an improved process to remove the nitrogen impurities from vacuum gas oils.

SUMMARY AND OBJECTS OF THE INVENTION

An object of the present invention is to provide a process which obviates the above mentioned drawbacks.

Another object of the present invention is to provide an improved process to remove nitrogen compounds from gas oils.

Another object of the present invention is to provide a process to remove nitrogen compounds from vacuum gas oils, without resulting in gas oil losses and without forming unusable sludges.

Another object of the present invention is to provide a process to remove basic nitrogen compounds from mixtures of waxy hydrocarbons, said process enabling to obtain a significant increase in conversion in the catalytic cracking.

The process of the present invention to remove basic nitrogen compounds from gas oils, by means of organic or inorganic acids, comprises treating said gas oils with a homogeneous mixture comprising a diluted aqueous solution of an acid and an alcohol having from 1 to 6 carbon atoms, the volume ratio of alcohol to diluted aqueous solution being between 90/10 and 10/90.

Although results have already been observed with alcohol contents lower than 10%, it is however preferable to use at least 10% alcohol in the solvent mixture in order to obtain a significant result.

BRIEF DESCRIPTION OF THE DRAWING

The FIGURE schematically depicts a continuous process of the invention.

DETAILED DESCRIPTION OF PREFERRED EMBODIMENTS OF THE INVENTION

A preferred process of the invention comprises continuously

- introducing, into a mixer-settler, the gas oil feed together with the diluted aqueous acid solution;
- transferring the resultant mixture to a separation column in order to separate the treated gas oil from the solvent mixture; and
- recovering the treated gas oil having a considerably reduced basic nitrogen compounds content.

The process of the invention may be applied to vacuum gas oils and particularly to hydrocarbons having a boiling point ranging between 300° C. to 600° C. Particularly, the process of the present invention may be applied to high viscosity hydrocarbons resulting from the vacuum distillation of crude oil. The process of the invention is particularly advantageous for the treatment of vacuum gas oils resulting from visbreaking or coking, as well as virgin vacuum gas oils from crude oil rich in basic nitrogen compounds.

The hydrocarbons used in the process of the invention comprise waxy hydrocarbons or vacuum gas oils which contain a non-negligible amount of aromatic hydrocarbons. These hydrocarbons have a basic nitrogen compounds content which may easily reach 1000 ppm by weight, and should not be submitted as such to catalytic cracking because, since the catalyst would be poisoned, the conversion would be drastically reduced.

Basic nitrogen compounds which are often met include pyrrolidine, pyrazine, pyridine, quinoline, phenazine and acridine.

When the process of the invention is applied, the amount of these compounds is generally reduced to a level of less than about 200 ppm by weight, which may be considered as an acceptable level for catalytic cracking. However, it is to be noted that it is preferred to reduce the basic nitrogen compounds content as far as possible.

According to the prior art, this type of hydrocarbon is treated with concentrated sulphuric acid. However sludges are formed which contain a very high percentage of sulphur.

The present inventors have unexpectedly found that these hydrocarbon mixtures may be treated with a homogeneous mixture comprising a moderately diluted aqueous acid solution and an alcohol having from 1 to 6 carbon atoms. The presence of an alcohol in the aqueous acid solution has a beneficial effect and avoids the formation of sludges, which are due to sulfonation, while maintaining a significant elimination of the basic nitrogen compounds. It is preferable that the alcohol used is miscible in the mixture in order to avoid the formation of a second phase. The efficiency of the solvent mixture would be lower if it is present under two phases.

The amount of basic nitrogen compounds removed increases with the amount of alcohol present in the alcohol/aqueous acid solution mixture. Improvement is noted with an alcohol amount in the mixture of only 2% by volume. However, better results are obtained with homogeneous mixtures having at least 50% by volume of alcohol, and more particularly with homogeneous mixtures containing from 50 to 90% by volume of alcohol.

Suitable examples of alcohols miscible with the aqueous acid solutions include methanol, ethanol, propanol, isobutanol, butanol and cyclohexanol. However, for economy and ease of supply, methanol and isobutanol are preferably used.

The presence of an alcohol has a synergistic effect on the elimination of the basic nitrogen compounds. Indeed, when alcohol is present in the above amounts, aqueous acid solutions much more diluted than those usually employed may be used; moreover, if said diluted solutions are used alone, they will have little effect on the removal of basic nitrogen compounds.

Diluted aqueous acid solutions may be used in which the acid content of the homogeneous water/alcohol mixture does not exceed 5% by volume. A significant effect on the removal of the basic nitrogen compounds is obtained with an acid concentration in the water/alcohol mixture of about 1% by volume. A lesser acid content leads to a much lesser removal of the basic nitrogen compounds, while acid contents higher than 5% lead eventually to sulfonation.

To perform the process of the invention, an inorganic acid may be used as well as an organic acid. Examples of suitable acids include HCl, HBr, HF, HI, perchloric acid, sulfuric acid, phosphoric acid, fluorosulphuric acid, trifluoroacetic acid, trichloracetic acid, formic acid, alkane sulfuric and alkylbenzene sulfonic acids. However, sulphuric acid is generally used due to ease of storage and handling. On the other hand, it is preferable to avoid the use of acids which may poison catalysts used for further treatment of the gas oils.

The amount of mixture of aqueous acid solution/alcohol to be used in view of the amount of hydrocarbon to be treated for carrying out the process of the invention may vary within wide limits. Indeed, the volume ratio between the amount of aqueous acid solution/alcohol mixture and the amount of hydrocarbons is between 0.5 and 5, preferably between 1 and 2.

To facilitate handling of the hydrocarbons to be treated, it is preferable to heat them somewhat in order to work at an elevated temperature, preferably between 45° and 85° C., more preferably between 50° and 75° C. Temperature variations practically do not influence the yield of the extraction of the basic nitrogen compounds.

The process of the invention may be carried out either in batches or continuously.

Referring now to FIG. 1, which describes a continuous embodiment of the process of the invention, the gas oil stored in the storage tank 10 is sent to mixer 12 by pipe 11. Mixer 12 may be of any known type, such as a static mixer, mixer-valves and analogs.

A sufficient amount of acid is also sent to mixer 12, by pipe 13, while the alcohol/water mixture is sent to mixer 12 by pipe 14. After mixing and settling of the resultant mixture, one withdraws by pipe 15 a mixture containing gas oil and a low amount of water, acid and alcohol, while the majority of the water/alcohol mixture is withdrawn by pipe 16.

The mixture which passes through pipe 16 is submitted to a purge to eliminate accumulated salts which result from the reaction of acid with the basic nitrogen compounds, and thereafter is recycled to storage tank 17 of the alcohol/water mixture.

The mixture withdrawn by pipe 15 is sent into a steam separator 18 in order to separate gas oil from the solvent mixture. The top product of the separator 18 passes through pipe 19, and comprises a mixture containing a major part of water and alcohol, and a minor part of hydrocarbons, together with an amount of products resulting from the neutralization of the basic nitrogen compounds by the water/acid/alcohol mixture. This mixture is sent into a separator 20 in order to separate the hydrocarbons from the water/alcohol mixture. The hydrocarbons pass through pipe 28 for further uses, while the alcohol/water mixture is sent by pipes 21 and 22 to a distillation column 23 which enables to carry out the necessary separation in order to thereafter recycle alcohol through pipe 27 to storage tank 17, and to send water by pipe 26 to a suitable treatment unit (not represented). The treated gas oil coming out of pipe 24 is sent through a neutralization device 25 before being sent to the catalytic cracking unit.

It is understood that other means may be used to carry out the process of the invention while remaining within its scope. The following examples are given in order to better illustrate the process of the present invention but without limiting it.

EXAMPLE 1

The following mixtures were simultaneously introduced into a mixer-settler:

- a hydrocarbon mixture of the vacuum gas oil type, the characteristics of which are indicated in Table I, having a basic nitrogen compounds content of 728 ppm;
- a homogeneous solvent mixture comprising 50 parts by volume of an aqueous solution of sulphuric acid and 50 parts by volume of isopropanol, the acid content of the solvent mixture being 1%.

TABLE I

| | |
|---|---|
| Specific gravity | 0.947 |
| Sulphur | 3.08% |
| Basic nitrogen compounds | 728 ppm |
| Viscosity at 50° C. | 52.6 centistokes |
| 80° C. | 15.8 centistokes |
| Carbon Conradson | 1.05 |
| Refractive Index at 80° C. | 1.508 |
| Aniline point | 66.4° C. |

The volume ratio between the solvent mixture and the hydrocarbons was 2:1. The hydrocarbon mixture was treated at a temperature of 75° C.

The hydrocarbon phase was then withdrawn from the mixer-settler and sent into a separator. In this latter, steam was introduced in order to separate the residual solvent mixture.

The gas oil withdrawn from this separator contained only 367 ppm of basic nitrogen compounds.

The so treated gas oil was submitted to a test of catalytic cracking in a pilot plant. A conversion of 3.2% higher was observed in comparison to that of an untreated feed.

EXAMPLE 2

The process described in Example 1 was repeated, but while modifying several operating conditions such as the alcohol content, the acid content, and the amount of solvent.

The vacuum gas oil feed had the following characteristics:

TABLE II

| | |
|---|---|
| Specific gravity | 0.949 |
| Sulphur | 2.7% |
| Total nitrogen | 3880 ppm |
| Basic nitrogen | 751 ppm |
| Viscosity at 50° C. | 51.5 centistokes |
| 80° C. | 15.6 centistokes |
| Carbon Conradson | 0.94 |
| Refractive Index at 80° C. | 1.509 |
| Aniline point | 68.4 |

The operating conditions, together with the results obtained regarding elimination of basic nitrogen compounds, are indicated in Table III.

TABLE III

| Run | vol. % $H_2SO_4$ in solvent | T °C. | Alcohol | Vol. ratio Solvent/hydrocarbons | Vol. ratio Alcohol/water | Basic Nitrogen compounds content (ppm) |
|---|---|---|---|---|---|---|
| 1 | 1 | 75 | isopropanol | 1 | 50/50 | 472 |
| 2 | 1 | 75 | isopropanol | 2 | 50/50 | 398 |
| 3 | 3 | 75 | isopropanol | 1 | 50/50 | 346 |
| 4 | 3 | 75 | isopropanol | 1 | 70/30 | 234 |
| 5 | 1 | 60 | methanol | 2 | 90/10 | 174 |
| 6 | 3 | 60 | methanol | 1 | 50/50 | 448 |
| 7 | 3 | 60 | methanol | 2 | 25/75 | 650 |
| 8 | 5 | 75 | isopropanol | 2 | 20/80 | 642 |
| 9 | 3 | 75 | isopropanol | 2 | 80/20 | 198 |

By way of comparison, the same gas oil was treated with the following solvent mixtures according to the herebelow described conditions.

| Comparative run | vol. % $H_2SO_4$ in solvent | T °C. | Alcohol | Vol. ratio Solvent/hydrocarbons | Vol. ratio Alcohol/water | Basic Nitrogen compounds content (ppm) |
|---|---|---|---|---|---|---|
| 1A | 85% | 60 | — | 1/20 | — | 154 |
| 2A | 0 | 75 | Methanol | 1 | 80/20 | 751 |
| 3A | 1 | 75 | Isopropanol | 1 | 2/98 | 672 |
| 4A | 10 | 60 | — | 1 | — | 650 |

In run 1A, there is a loss under the form of a sludge, representing about 10% of the total weight of treated gas oil.

This clearly shows that if alcohol and acid are not conjointly used, it is not possible to obtain a significant reduction of the basic nitrogen compounds, unless concentrated acid solutions are used with their known drawbacks.

In order to show the influence of the elimination of the basic nitrogen compounds on the catalytic cracking of these gasoils, they have been submitted to a MAT test according to the following conditions:

The gas oil feed is passed into a piston flow reactor at a temperature of 482° C. during a period of 75 sec. on a catalyst of the zeolite type usual for the catalytic cracking.

The MAT conversion is indicated in the following Table.

| Run | Conversion MAT |
|---|---|
| untreated feed | 41.2% |
| 4 | 52.0 |
| 5 | 53.1 |
| 9 | 52.3 |

The same feeds have also been tested in a catalytic cracking pilot plant and the improvement in conversion, with regard to the conversion obtained with an untreated feed, was respectively of 3.7% for run 4
5.2% for run 5
4.7% for run 9

What is claimed is:

1. A process for removing basic nitrogen compounds from gas oils, comprising treating said gas oils at a temperature of 45° to 85° C. with a homogeneous solvent mixture comprising a dilute aqueous acid solution and an alcohol having from 1 to 6 carbon atoms, the volume ratio of alcohol to dilute aqueous acid solution being between 90/10 and 10/90, the volume ratio of solvent mixture to gas oils being between 0.5 and 5.

2. A process according to claim 1, wherein the acid content of said solvent mixture is between 1 and 5% by volume.

3. A process according to claim 1, wherein said alcohol is selected from the group consisting of methanol, isopropanol, ethanol, propanol, isobutanol, butanol and cyclohexanol.

4. A process according to claim 1, wherein said acid is selected from the group consisting of hydrochloric, hydrobromic, hydrofluoric, hydroiodic, perchloric, sulphuric, phosphoric, fluorosulphuric, trifluoracetic, trichloroacetic, formic, alkane sulphuric and alkylbenzene sulfonic acids.

5. A process according to claim 1, wherein the volume ratio of alcohol to dilute aqueous acid solution is higher than 50/50, and the volume ratio of solvent mixture to gas oil is between 1 and 2.

6. A continuous process for removing basic nitrogen compounds from gas oils, comprising:

continuously introducing into a mixer-settler, at a temperature of from 45° to 85° C., a gas oil feed together with a homogeneous solvent mixture comprising an alcohol having from 1 to 6 carbon atoms and a dilute aqueous acid solution, the volume ratio of alcohol to dilute aqueous acid solution being between 90/10 and 10/90, the volume ratio of solvent mixture to gas oil being between 0.5 and 5, the acid content of said solvent mixture being between 1 and 5% by volume to form an initial mixture;

continuously withdrawing said initial mixture from said mixer-settler and passing it through a separation column in order to separate treated gas oil from the solvent mixture; and continuously recovering the treated gas oil having a basic nitrogen compounds content considerably reduced.

7. A process for removing basic nitrogen compounds from gas oils, comprising treating said gasoils at a temperature of 45° to 85° C. with a homogeneous solvent mixture comprising a dilute aqueous acid solution and an alcohol having from 1 to 6 carbon atoms, the volume ratio of alcohol to dilute aqueous acid solution being from 50/50 to 90/10, the acid content of said solvent mixture being between 1 and 5% by volume, and the volume ratio of solvent mixture to gas oils being between 0.5 and 5.

8. The process of claim 1, wherein the level of basic nitrogen compounds in the gas oils being treated is reduced to less than about 200 ppm by weight.

9. The process of claim 7, wherein the level of basic nitrogen compounds in the gas oils being treated is reduced to less than about 200 ppm by weight.

* * * * *